US006089435A

United States Patent [19]

Malek

[11] Patent Number: 6,089,435

[45] Date of Patent: Jul. 18, 2000

[54] COMBINATION STAPLER AND STAPLE REMOVER

[76] Inventor: Shahin S. Malek, 45 Rapp Rd., Albany, N.Y. 12203

[21] Appl. No.: 08/955,980

[22] Filed: Oct. 22, 1997

Related U.S. Application Data

[63] Continuation-in-part of application No. 08/706,239, Sep. 4, 1996, Pat. No. 5,749,564, and a continuation-in-part of application No. PCT/US97/15563, Sep. 4, 1997.

[51] Int. Cl.[7] ..... B25C 11/00

[52] U.S. Cl. ..... 227/63; 227/156; 254/28

[58] Field of Search ..... 227/63, 156, 134; 254/25, 28

[56] References Cited

U.S. PATENT DOCUMENTS

| | | | |
|---|---|---|---|
| 2,102,087 | 12/1937 | Pankonin | 227/63 |
| 2,233,958 | 3/1941 | Obstfeld et al. | 227/63 |
| 2,675,989 | 4/1954 | Vogel | 227/63 |
| 4,002,281 | 1/1977 | Hsu | 227/63 |
| 4,114,793 | 9/1978 | Hsu | 227/63 |

*Primary Examiner*—Scott A. Smith
*Attorney, Agent, or Firm*—Jay R. Yablon

[57] ABSTRACT

A device for removing staples from papers, cloth, or other material without tearing or mutilating the material. The device utilizes a heel of palm to finger gripping action to facilitate a more natural action for removing staples. Staples are extracted by way of a jaw which opposes a wedge-shaped piece to an abutting plate piece, which straightens the staple while simultaneously pulling it out of the paper in a perpendicular direction. The wedge-shaped piece includes a portion where its width and thickness increase to dimensions wherein the sum of the width plus twice the thickness exceeds the slightly less than the total length of the three sides of the staples being removed, thus facilitating complete extraction. The device is readily incorporated into a standard stapler, so that both staple insertion and staple removing functionality are readily incorporated within a single device.

21 Claims, 14 Drawing Sheets

COMBINATION STAPLER AND STAPLE REMOVER

CROSS-REFERENCE TO RELATED APPLICATIONS

This application is a continuation-in-part of U.S application Ser. No. 08/706,239 filed Sep. 4, 1996, now U.S. Pat. No. 5,749,564. This application is also a continuation-in-part of pending PCT Application PCT/US97/15563 filed Sep. 4, 1997, which designates the United States. This application further claims priority benefit of said pending PCT application PCT/US97/15563 filed Sep. 4, 1997, which designates at least one country other than the United States.

FIELD OF THE INVENTION

The present invention generally relates to devices for removing staples from paper, cloth, or other material without tearing the material. Also disclosed are several embodiments for manufacturing said staple removing device, including a low-cost unibody method. Also disclosed is a combination of both stapling and staple removal into a single device.

BACKGROUND OF THE INVENTION

1. Technical Field

Due to the common use of staples as fasteners, staple removers may be found in almost any office and used in many other applications, such as interior design, fabric production and tailoring, etc. For example, many times staples must be removed to allow papers to be individually copied or to insert an edited form or page. Whatever the reason for wanting to remove a staple from papers, cloth, or other material, it is desirable to do so without tearing or mutilating the material being held together or in place.

Pulling staples manually from materials such as sheet papers is not only extremely inconvenient, but can rarely be accomplished without tearing or mutilation of the stapled material. Thus, various devices have been invented to facilitate easier removal of staples.

Most staple removers require further pulling of the staple after the remover has engaged the staple. Thus, use of these devices often results in tearing of the stapled material.

A further problem with many staple removers is their small size and the manner of gripping them for use. Since many staple removers utilize either a "plier-type" gripping action or a "thumb to finger" action the user must pick-up the stapled material, such as papers, in order to achieve a comfortable angle for use of the staple remover. Furthermore, these types of grips naturally facilitate the tendency of users to pull the remover away from the material, thus increasing the chance of tearing.

In addition, it is inconvenient to have to purchase and maintain separate stapler and staple removing devices, which is the common—indeed pervasive—practice in the art.

2. Background Art

Typical staple remover devices for removing staples from paper are disclosed in U.S. Pat. No. 1,922,681 to Heise, U.S. Pat. No. 2,678,575 to Marano, U.S. Pat. No. 2,431,922 to Curtiss, U.S. Pat. No. 2,662,727 to Yerkes, and in U.K. Patent No. 862,468 to Balma et al. and Italian Patent No. 1,220,438 to Balma, et al.

The staple remover disclosed by Heise (U.S. Pat. No. 1,922,681) utilizes two hinged members with a pair of jaws on one end and a pair of handles on the other. This device utilizes a thin blade and a prong engaging portion to pull the staple from the pages. Thus, the staple is dragged by the engaging portion across the length of the blade as it is removed. Although this may decrease mutilation of papers resulting from manual extraction of staples, it may not do so adequately since the staple is extracted at an angle rather than being lifted out in a perpendicular direction.

U.S. Pat. No. 2,678,575 to Marano reveals a plier-type implement with a pair of elongated members secured together at one end, and normally divergent at their other ends. This device, like Heise, utilizes a thin blade opposed to a prong engaging portion to pull the staple from the pages, and presents roughly the same difficulties. Since the blade is thin, the staple is straightened by pulling it across an abutment at an angle, thus increasing the likelihood of tearing.

The staple remover disclosed by Curtiss (U.S. Pat. No. 2,431,922) involves two elongated arms pivotally attached at one end and normally divergent at their other ends due to the bias created by the free ends of a spring located about the pivot. This device removes a staple by engaging the top portion of the staple with notches and flanges on the lower arm, and then utilizing a thin blade and flanges on the upper arm to pull the staple while simultaneously straightening its legs.

U.K. Patent No. 862,468 to Balma, et al. discloses a plier-like device for detaching metallic staples. (See also Italian is Patent 1,220,438 to Balma, et al.) This device utilizes a tapered tongue-like projection of substantially triangular configuration which may be tapered with respect to its width and with respect to its thickness attached to one side of the jaws, and used an abutting means on the other side of the jaws to extract the staple. It extracts staples by driving the tapered-tongue like projection underneath the top portion of a staple with an abutting means when the handles of the device are squeezed together.

The staple remover disclosed by Yerkes (U.S. Pat. No. 2,662,727) has a plate which is parallel to the front surface of a wedge-shaped piece, which results in the staple being pulled by both the wedge-shaped piece and the plate. Indeed, the staple being pulled by both pieces is a common cause of tearing in many staple removers.

All of these devices are operated horizontally by gripping their handles with the thumb on top and the fingers underneath in a grip similar to that used in operating pliers or scissors. The Curtiss device could be operated vertically with a heel of the palm to finger grip, but is not designed to comfortably accommodate such use.

This plier-type grip is less comfortable than a heel of the palm to finger grip when operating a staple remover in a vertical position. Furthermore, operators are more likely to pull on the staple remover device when operating a device horizontally using a plier-type grip than when operating a device vertically using a heel of the palm to finger grip. If a smaller staple remover is desired, such as one that utilizes the thumb on one side and the index and middle fingers on the other side, it would be desirable to incorporate a design that continues to prevent pulling or tearing of the material.

Therefore, a need exists for a staple removing device that completely removes the staple without requiring additional pulling away from the paper, cloth, or other material after the device engages the staple, and which will remove the staple without tearing or mutilating the paper, cloth, or other material. Also, there is a need for a staple remover that may be more comfortably and naturally used, and that minimizes the tendency of the user to pull the remover away from the paper prior to complete extraction of the staple.

Further, the need exists for a device which combines ability to both staple and remove staples, into a single unit, eliminating the need for separate staplers and staple removers.

The aforementioned art is hereby incorporated by reference.

OBJECTS OF THE INVENTION

It is therefore an object of the present invention to have a series of depressions on the upper arm designed to facilitate more comfortable and more efficient removal of staples by allowing the staple remover to be operated in a vertical rather than a horizontal position.

It is therefore a further advantage of the present invention to provide a finger guard whereby the fingers of the user are protected while holding the staple remover.

It is therefore a further advantage of the present invention to provide a wedge versus abutment jaw which includes a wedge-shaped piece where the sum of lengths of the top three sides at its thickest point exceeds the length of the three sides of a standard staple.

It is a further advantage of this invention to provide a staple remover which includes a geometry to remove a staple without tearing the paper, wherein the staple is entirely removed from the paper by a wedge-shaped piece having an arc thereon. This allows the remover to slide easily under the staple.

It is a further advantage of this invention to combine stapling and staple removal in a single device.

SUMMARY OF THE INVENTION

The present invention addresses the need for a staple remover that minimizes the tendency to pull the staple away from the paper before it has been completely straightened. It also minimizes tearing of the stapled papers when the staple is extracted.

The present invention provides, in its first aspect, a staple remover device utilizing two arms pivotally attached to each other at their ends. It further provides a wedge-shaped piece where sum of lengths of three sides at its thickest point exceeds slightly less than the length of the three sides of a standard staple (22 millimeters), thus straightening and removing staples completely. It also provides a finger grip and a finger guard which facilitate comfortable and efficient use of the device.

Because this staple remover makes use of a pivotal rotation identical to that used in staplers, a further embodiment is disclosed wherein the functionality of this staple remover is combined with that of a standard stapler.

BRIEF DESCRIPTION OF THE DRAWING

The features of the invention believed to be novel are set forth in the appended claims. The invention, however, together with further objects and advantages thereof, may best be understood by reference to the following description taken in conjunction with the accompanying drawing(s) in which:

DETAILED DESCRIPTION OF THE PREFERRED EMBODIMENT OF THE INVENTION

Figure 1:
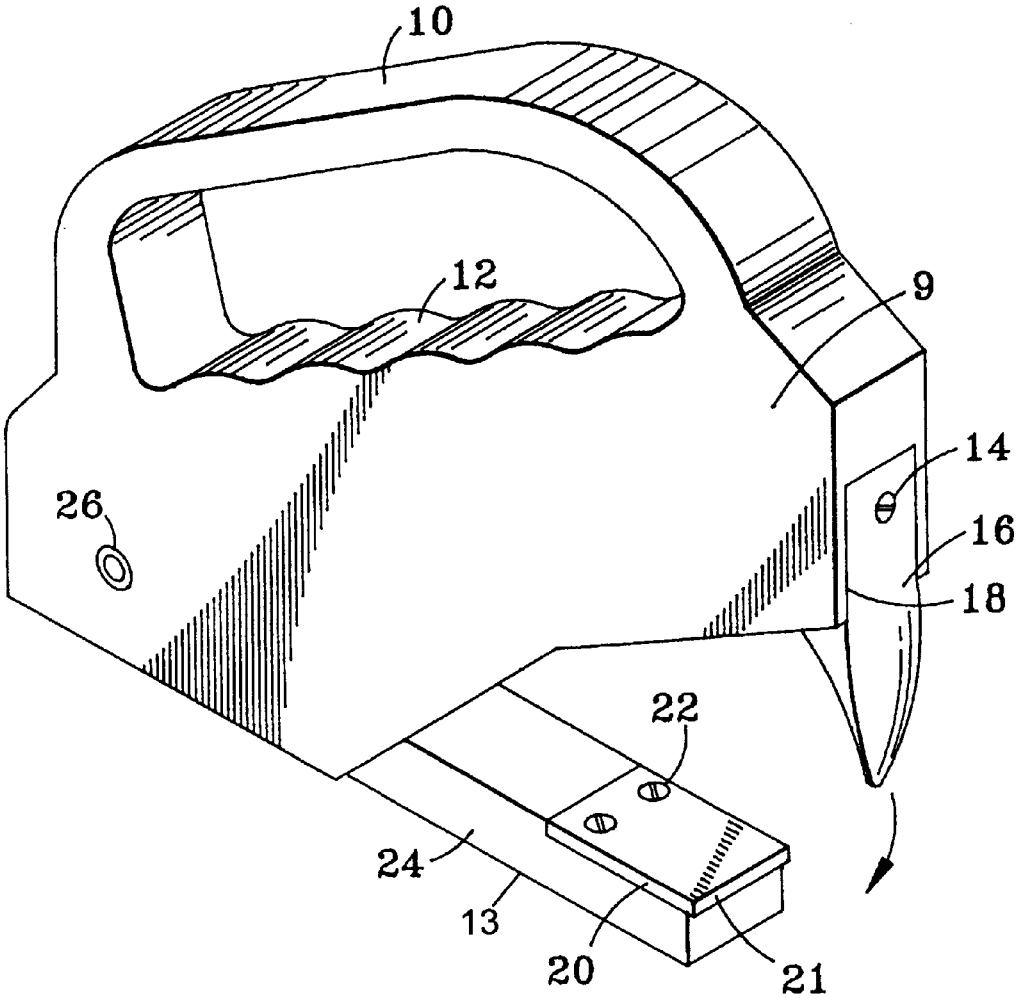
FIG. 1 is a side perspective view of the first preferred embodiment.
Figure 10:
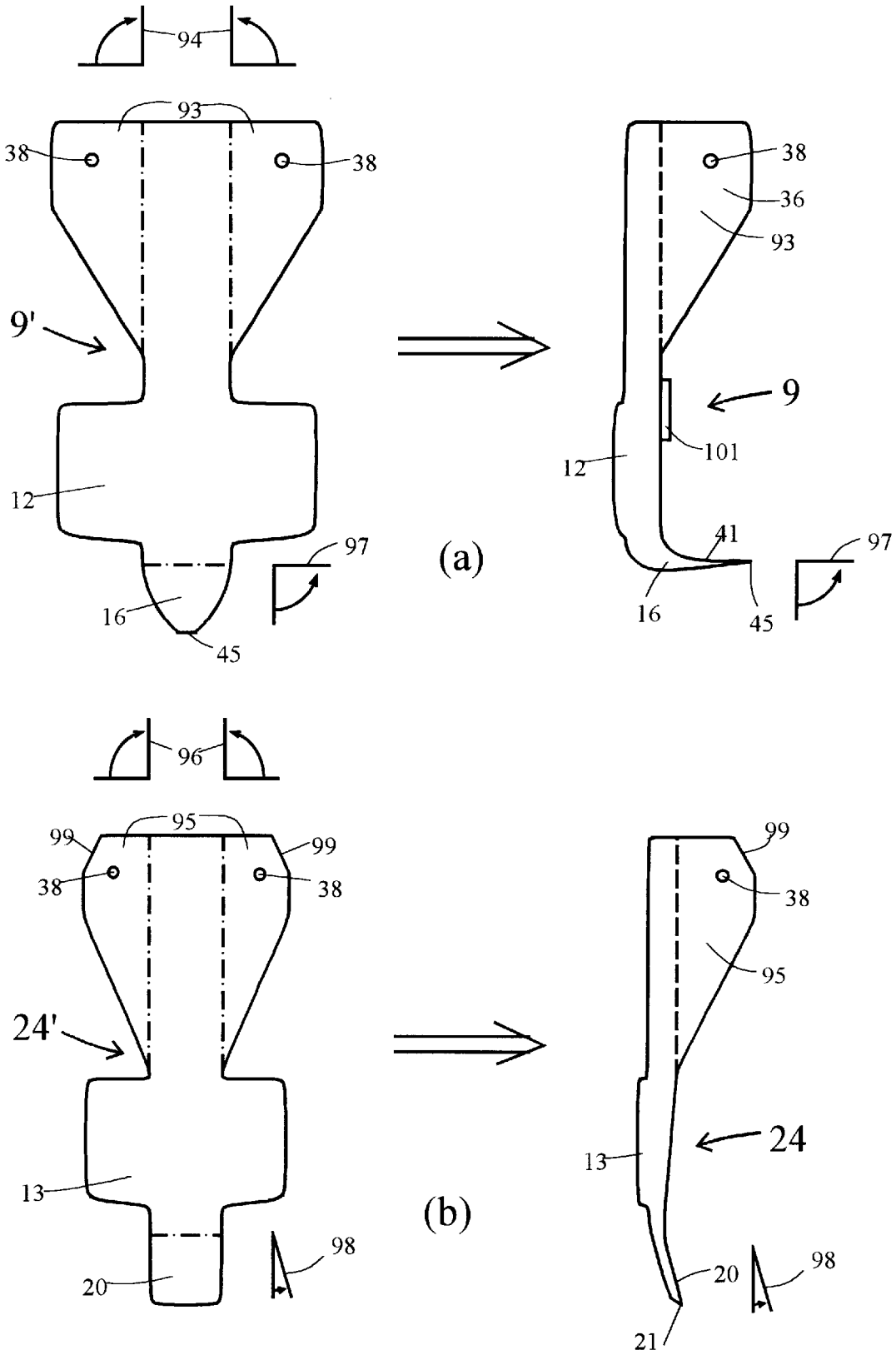
FIG. 10 illustrates a unibody method for fabricating the arms and operational components of this device.
Figure 11:
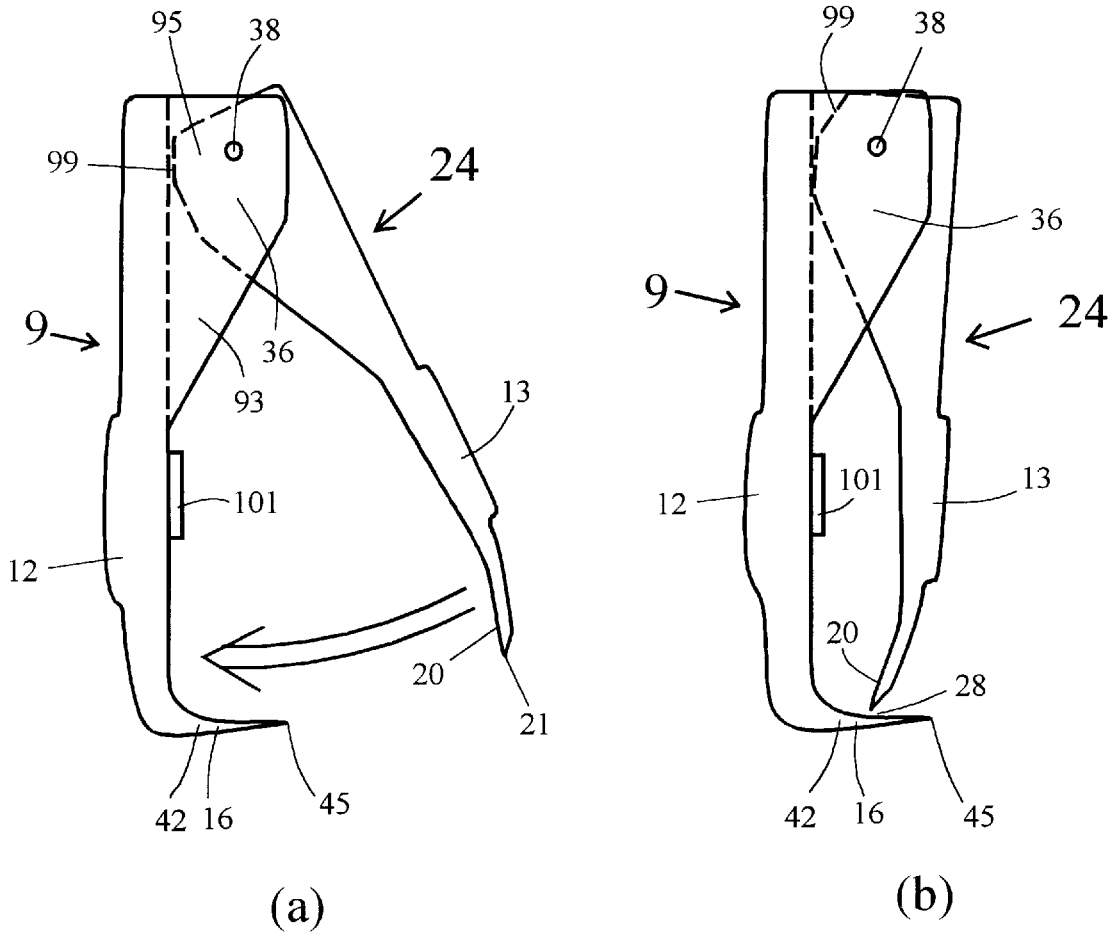
FIG. 11 is a side view of the fourth preferred, unibody embodiment of the invention.

Referring to FIG. 1, there is illustrated a staple-remover device, in accordance with the first preferred embodiment of the present invention. The device includes a first arm 9 and a second arm 24, which are held together at one end by a pivoting means 26. The first arm includes gripping means 12 such as a series of depressions as shown in FIG. 1, or the gripping wings as shown in FIGS. 10 and 11, to facilitate gripping when the device is operated in a vertical position with the heel of the palm against the bottom of the second arm 24 and the fingers positioned in the gripping means' 12 series of depressions. The second arm 24 may also include a complementary gripping means 13 such as a palm indentation, or complementary gripping wings as shown in FIGS. 10 and 11. The first arm 9 also includes a finger shield 10 such as the depicted finger guard, to protect the operator's ringers during use of the device.

Attached to an indentation 18 in the first arm 9 is a wedge-shaped piece 16 (also frequently referred to herein as a blade). This piece is held tightly to the first arm 9 by means of a screw 14.

The second arm 24 is an elongated piece that may be unshaped or channel shaped in the transverse. Attached to an indentation in the second arm 24 is a plate 20 made of hard material such as metal, a flat edge 21 of which slightly exceeds the end of the second arm 24. This plate is held tightly in place by means of screws 22.

Figure 2:
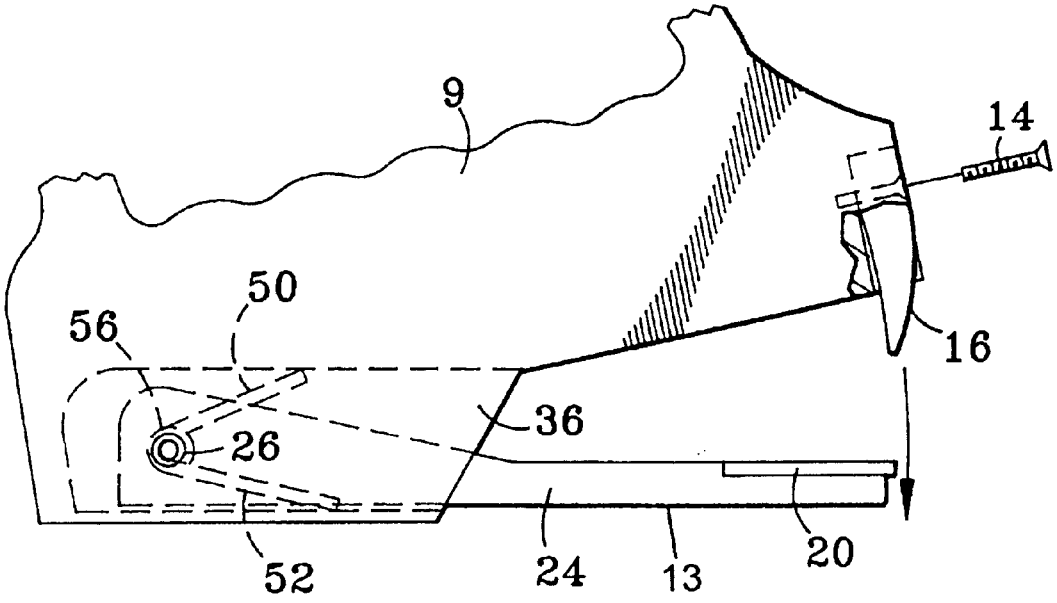
FIG. 2 is a side view of the first preferred embodiment with the arms in their natural open position.

Referring to FIG. 2, a side view of the staple remover is shown in accordance with the first preferred embodiment of the invention. This view depicts the staple remover in its natural or open position with the first arm 9 diverging from the second arm 24 at one end. In this position, the bias of the spring 56 as exerted through the second spring end 50 and the first spring end 52 holds the first arm 9 and the second arm 24 apart.

As depicted, second spring end 50 presses against the interior end surface of the female slot 36 of first arm 9. The first spring end 52 presses against the interior surface of the second arm 24. In this position the bottom surface of the female slot 36 of the first arm 9 is parallel to the second arm 24.

Figure 3:
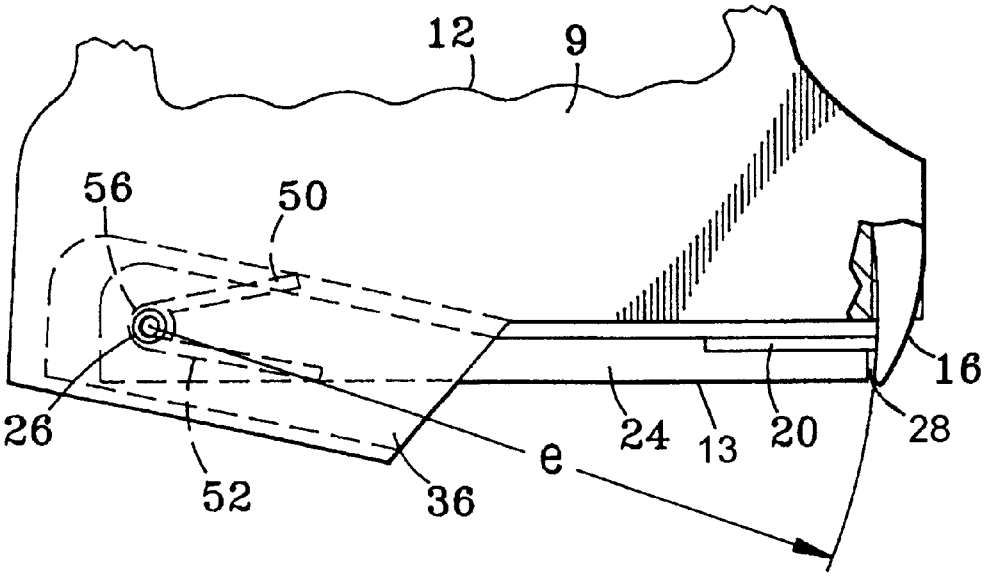
FIG. 3 is a side view of the first preferred embodiment with the arms closed to show the interaction of the wedge-shaped piece and the plate.

Referring to FIG. 3, a side view of the staple remover is shown, in accordance with the first preferred embodiment of the invention. This view depicts the first arm 9 as it appears when it has been squeezed against the second arm 24.

In this closed position, the wedge-shaped piece 16 abuts the plate 20. Furthermore, the female slot 36 of first arm 9 exerts pressure against the second spring end 50, thus decreasing the distance between the second spring end 50 and the first spring end 52. The spring 56 is also depicted, being held in place by the pivoting means 26.

The staple remover is typically operated in the vertical position as shown, with the heel of the user's palm pushing against the second arm 24, and the user's fingers utilizing the gripping means' 12 series of depressions to pull on the first arm 9.

Figure 4:
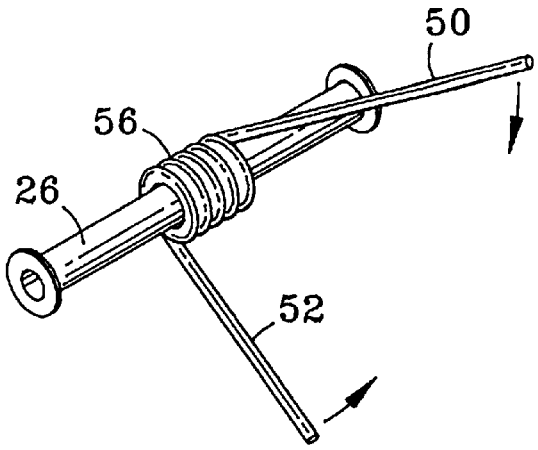
FIG. 4 is a depiction of the spring apparatus positioned around the pivot apparatus.

Referring to FIG. 4, the spring 56 is depicted. As shown, the spring is held in place by the pivoting means 26 which penetrates spring's 56 hollow center.

Figure 5:
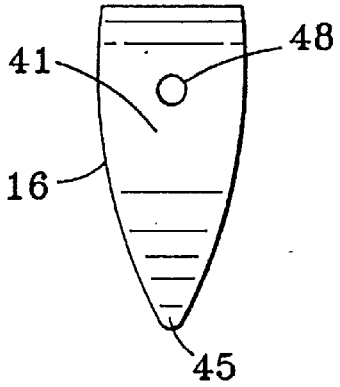
FIG. 5 is a front view of the first preferred embodiment of the wedge-shaped piece.
Figure 6:
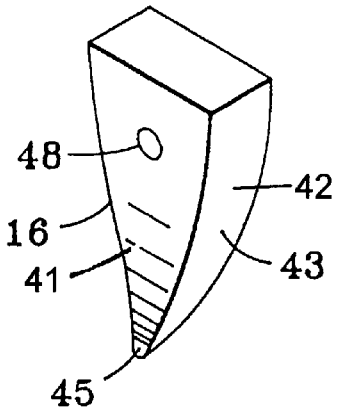
FIG. 6 is a back perspective view of the first preferred embodiment of the wedge-shaped piece.

Referring to FIGS. 5 and 6, the wedge-shaped piece 16 is depicted in accordance with the first preferred embodiment of the invention. This wedge-shaped piece 16 is substantially triangular in shape at one end, and rectangular in shape at the other end. The piece both widens and thickens from the tip 45 towards its central (removal) region, to a width and a thickness wherein the sum of the width plus twice the thickness at this central (removal) region 42 exceeds the total length of the three sides of the staple to be removed (which, for a standard staple, is 22 millimeters=12 millimeters (body)+5 millimeters (first leg)+5 millimeters (second leg)), and ensures that the staple legs will be gradually straightened (unfolded) and the staple will then fully and cleanly removed when the two arms of this device are pressed together as in FIG. 3. (In actuality, when this device is used, the staple is removed for all practical purposes once a total length of substantially 18 millimeters on the three side of the blade has been reached, and so an 18 millimeter total length—and generally, approximately four millimeters less than the total length of the staple being removed—will suffice.) At this point, the wedge-shaped piece 16 becomes rectangular.

The front surface 41 of the wedge-shaped piece 16 curves down to the tip 45 on one side and is flat on the other. A hole 48 provides a means whereby the wedge-shaped piece 16 may be attached to the staple remover with a screw or other fastening device.

FIG. 6, depicts a perspective view of the wedge-shaped piece 16. The front surface 41 must be arced with the arc having a radius of curvature determined such that the origin of the arc coincides substantially with the position of said pivot point, and the wedge-shaped piece 16 widens and thickens from the tip toward its central (removal) region 42 as shown, with the thickening occurring on its rear surface opposite the front surface 43 (see also, FIG. 2). Thus, when the remover arms are pressed together as shown in FIG. 3, the plate will be perpendicular to a line tangent to the arc of the wedge-shaped piece at the point of closest proximity between the wedge-shaped piece 16 and the plate 20, and these pieces 16 and 20 will thereby maintain a small, substantially fixed distance 28 (less than the gauge thickness of a staple—see FIG. 3) from one another throughout the movement of the wedge-shaped piece 16 past the plate 20. This view also depicts a hole 48 for attachment.

Figure 7:
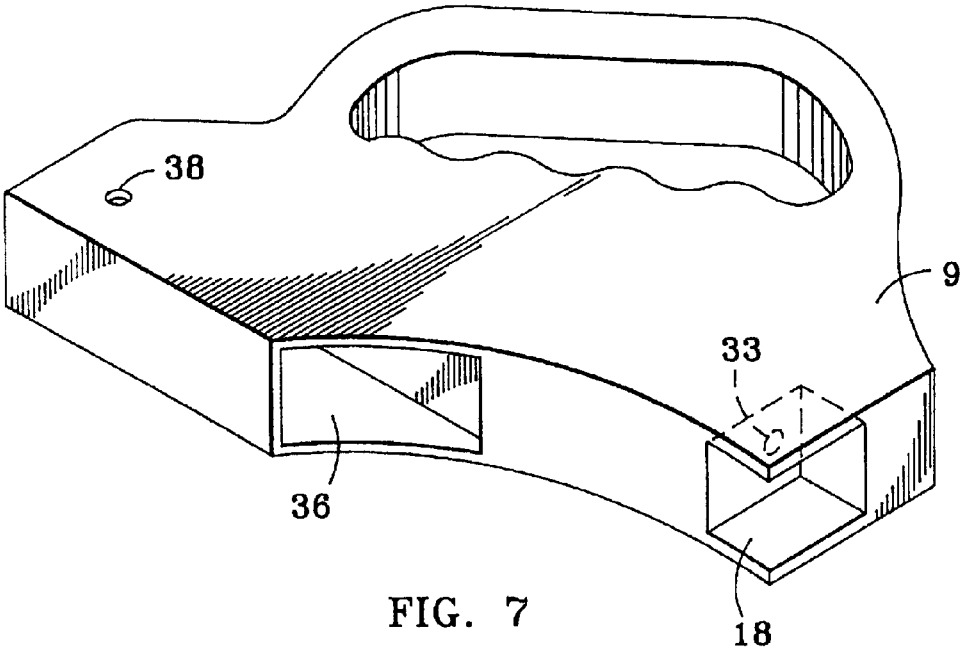
FIG. 7 is a perspective view of the top arm of the first preferred embodiment.

Referring to FIG. 7, a perspective view of the first arm 9 is shown in accordance with the first preferred embodiment of the invention. A female slot 36 is revealed whereby first leg 24 may be inserted and attached. This figure also depicts the indentation 18 to which the wedge-shaped piece 16 may be attached by means of a screw inserted into attachment hole 33. Two holes are also provided at a pivot point 38 on the back portion of the first arm 9 whereby a pivoting means 26 may be inserted.

Figure 8:
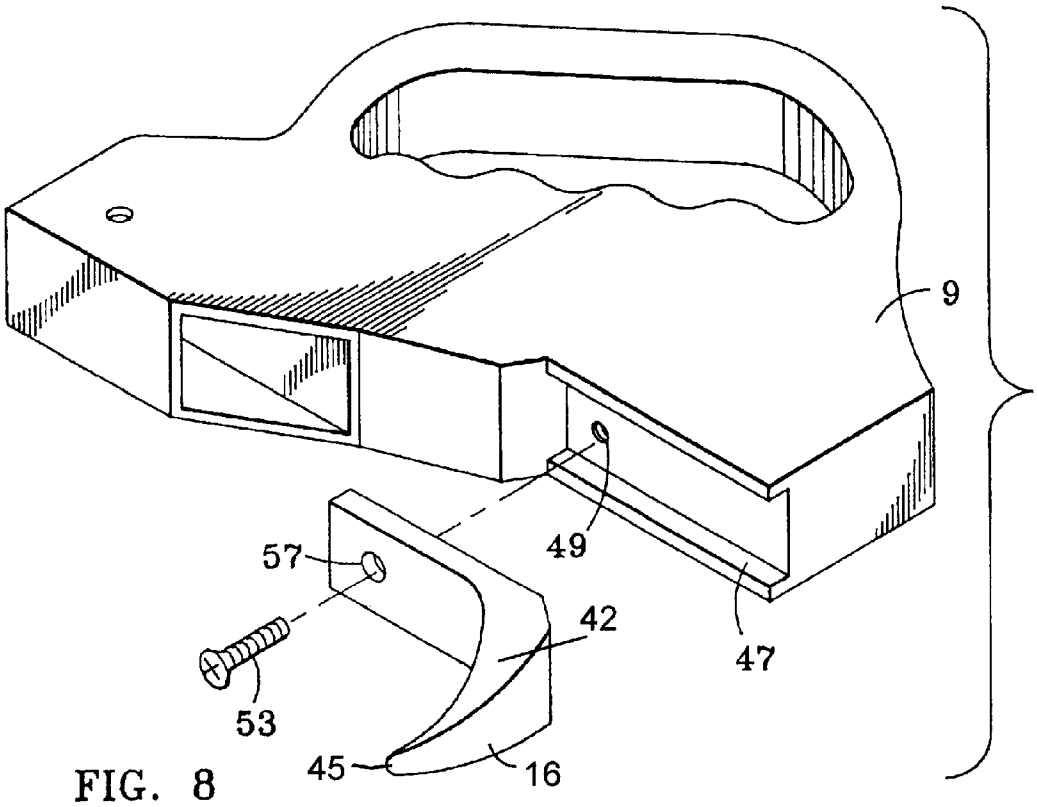
FIG. 8 is a perspective view of the top arm of the second preferred embodiment, and also depicts a perspective view of the second preferred embodiment of the wedge-shaped piece.

FIG. 8 discloses a second preferred embodiment of the present invention. In this embodiment, the wedge-shaped piece 16 is tapered and curved in a similar fashion to that in the first preferred embodiment. However, this embodiment includes an L-shaped curve at its central (removal) region 42 with a rectangular portion at its far end (the end most remote from the tip 45) as shown, and similarly to the first preferred embodiment (FIG. 5), widens and thickens from the tip 45 towards its central (removal) region 42. This piece is attached to the indentation 47 in the first arm 9 by inserting a screw 53 through hole 57 and into hole 49.

Figure 9:
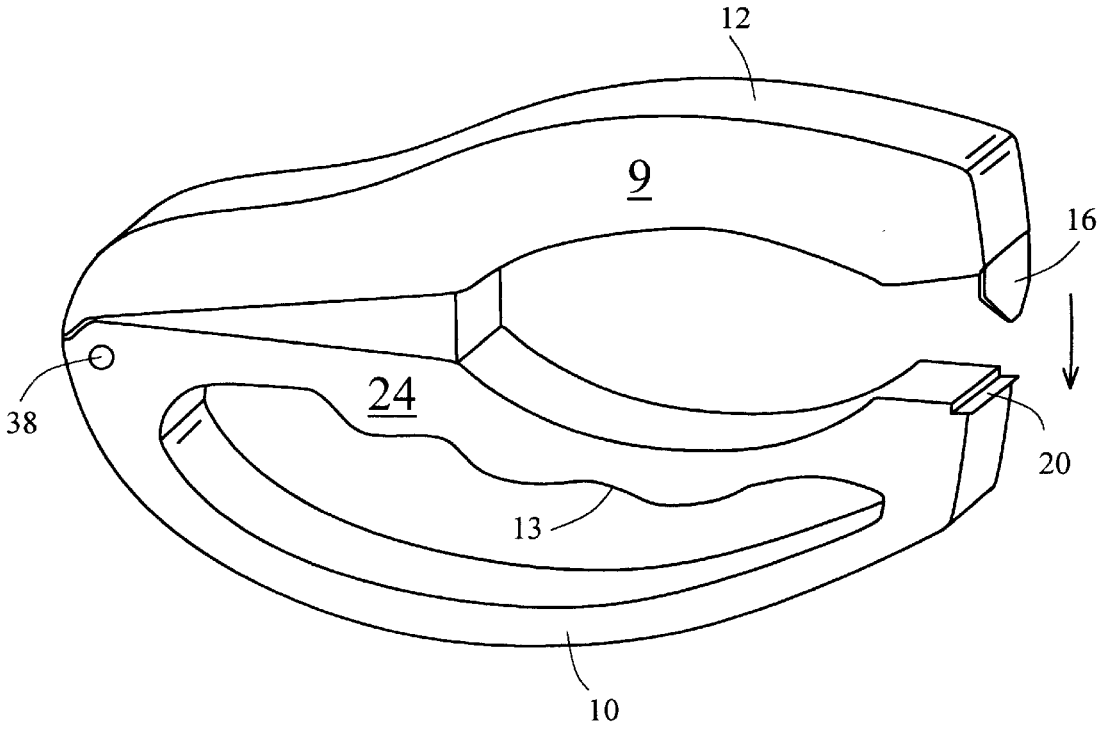
FIG. 9 is a perspective view of the third preferred embodiment of the invention.

FIG. 9 discloses a third preferred embodiment of the present invention. In this embodiment, the gripping means 12 on the first arm 9 is contoured as a palm grip, and the gripping means 13 on the second arm 24 is contoured as a finger grip, with a finger shield 10. Thus, when the palm is rested against 12 and the fingers against 13, the blade 16 in this embodiment points away from the user as it moves past the plate 20. The embodiments thus disclosed are not meant to be exhaustive, but rather illustrative of the range of possibilities for configuration, grips, etc.

The embodiments disclosed above utilize arms 9 and 24 that are manufactured separately from the wedge-shaped piece 16 and the plate 20. The wedge-shaped piece 16 and plate 20 are then screwed into the arms, see, e.g., the screws 14 and 22 in FIG. 1, and the screw 53 in FIG. 8. It may be desired, to eliminate the manufacturing step of screwing the wedge-shaped piece 16 and the plate 20 into the arms, and to reduce the number of distinct components involved, to manufacture the first arm 9 as a unitary piece with the wedge-shaped piece 16, and the second arm 24 as a unitary piece with the plate 20.

FIGS. 10 and 11 therefore, disclose a fourth preferred embodiment of the invention utilizing a unibody approach. The first arm 9 and second arm 24 are fabricated from a metallic or similar substance as illustrated in the left-most two drawings of FIG. 10. The material used for fabrication is a hard metal that can be pressed and bent under extremely-high pressure, but is otherwise rigid.

The first arm 9 is prefabricated into a first arm prefabrication piece 9' as shown in the upper left region of FIG. 10. A high-pressure molding and pressing process is then used to press this piece into the configuration depicted by the side view shown in the upper right region of FIG. 10. A variety of such molding and pressing processes are well-known in the art. In particular, the wedge-shaped piece 16 is bent downward at a substantially perpendicular angle 97, along the illustrated dash-dot line, so as to result in the configuration shown in the upper right section of FIG. 10, including the required arc, see, e.g., FIG. 6 and accompanying discussion. Similarly, a pair of first attachment members 93 are bent down at a substantially perpendicular angle 94, along the parallel dash-dot lines as shown, so as to also result in the configuration shown in the upper-right section of FIG. 10, which result in the creation of the female slot 36 used for later attaching the two arms together. The dotted line on the upper right drawing depicts the bottom face of the first arm 9, which, after fabrication, is hidden behind the first attachment members 93. Also depicted is the gripping means 12, which in this illustration, is embodied in a pair of gripping wings. The holes at the common pivot point 38 subsequently used to attach the first arm 9 and the second arm 24 together may either be punched into the first arm prefabrication piece 9' before the high-pressure process begins, or may be punched into this piece as part of the pressing process. Finally, note also that high temperatures, as necessary and suitable, may also be used as part of the fabrication (molding, pressing and bending) process. Also depicted on the first arm is a magnetic strip 101, which is used to attract and capture the staple once it is removed, thus averting the common nuisance whereby the staple, once removed, falls on the floor and must then be retrieved. Alternatively, one or both arms themselves, or sections thereof, may be magnetized so as to retain the staple once it is removed.

The second arm 24 is created in a similar way from a second arm prefabrication piece 24', into the configuration depicted by the side view shown in the lower-right region of FIG. 10. Here, the plate 20 is mildly bent to an angle 98 of approximately 15 degrees, along the illustrated dash-dot line, so as to result in the configuration shown in the lower right section of FIG. 10. Similarly, a pair of second attachment members 95 are bent down at a substantially perpendicular angle 96, along the parallel dash-dot lines as shown, so as to also result in the configuration shown in the lower right section of FIG. 10. The dotted line on the lower right drawing depicts the bottom face of the second arm 24, which, after fabrication, is hidden behind the second attachment members 95. Also depicted is the complementary gripping means 13, which in this illustration, is embodied in a pair of gripping wings. The holes at the common pivot point 38 subsequently used to attach the first arm 9 and the second arm 24 together, similarly, may either be punched into the second arm prefabrication piece 24' before the high-pressure process begins, or may be punched into this piece as part of the pressing process. Note also a pair of angled expansion stops 99, the function of which will be discussed shortly.

Once the first arm 9 and second arm 24 have been fabricated in this manner, they are attached together by sliding the second arm inside the female slot 36 of the first arm (the second arm is slightly less wide than the first arm for this reason, though this can of course be reversed within the scope of this invention), aligning the holes at the common pivot point 38, and using a pivoting means 26 and spring 56 as illustrated in FIG. 4, or any other similar method that may be obvious to someone of ordinary skill. The result of so attaching these arms 9 and 24 together is illustrated in FIG. 11. The net result is a staple remover operating on the same principle as the earlier embodiments, wherein the wedge-shaped piece 16 is arced with its focal point at the pivot point coinciding with the hole at the common pivot point 38, and the plate 20 moves past the wedge-shaped piece 16 so as to maintain a very small, substantially fixed distance, that is less than the gauge thickness of the staple being removed. Because the spring 56 tends to push the two arms apart (which is the natural position when the remover is not in use), the expansion stops 99 press against the bottom face of the first arm to stop expansion beyond the point depicted in the left side illustration of FIG. 11. Also depicted is the central (removal) region 42 which widens and thickens as one moves away from the tip 45, and the flat edge 21 of the plate, similarly to the earlier preferred embodiments disclosed.

Note that in the earlier embodiments, this plate 20 was unbent (i.e., the angle 98, FIG. 10, was zero degrees), so that it would be substantially perpendicular to a line tangent to the arc of the wedge-shaped piece 16 at the point of closest proximity between the wedge-shaped piece 16 and the plate 20. In FIGS. 10 and 11, this plate was bent to an angle 98 of fifteen (15) degrees. What is most important, however, irrespective of the bend angle of the plate, is that the plate 20 be oriented in such a way that it will simply hold the staple in place as the wedge-shaped piece 16 unfolds and lifts the staple for removal, rather than itself help in any way to lift the staple. Thus, any angle which achieves this net result, is fully acceptable and encompassed by this disclosure and its associated claims. Preferably, the plate may suitably be oriented with a bend of between minus thirty (−30) to thirty (30) degrees from the remainder of the second arm, which, after attachment of the first arm 9 and the second arm 14 as in FIG. 11, results in an angle between sixty (60) degrees and one hundred twenty (120) degrees, between the plate and said line tangent to the arc of the wedge-shaped piece 16. The fifteen (15) degree bend in FIG. 11 leaves a seventy five (75) degree angle between the place and said arc tangent line. This fifteen degree bend, as well as the zero degree bend shown earlier, and also a minus fifteen degree bend, are further preferred options within the above-stated ranges and subject to the above-stated constraints.

It is also helpful to briefly discuss the range of possibilities for the gripping means 12 and complementary gripping means 13. For a larger staple remover wherein one arm is held against the palm of the hand and the other arm is held with the four fingers opposite the palm, wherein the fingers and palm are then pressed together to use the remover, one arm may conveniently include a series of indentations such as shown in connection with the gripping means 12 as illustrated in FIGS. 1, 2 and 3, and the other arm may conveniently include a variety of curvatures suitable to comfortable placement against the palm. Many grip arrangements providing comfortable use, e.g., that of FIG. 9, will be obvious to someone of ordinary skill, and are contemplated by this disclosure and its associated claims. The placement of the indentations used for a finger grip on the first arm as shown in FIGS. 1, 2 and 3, and of any curvature used for a palm grip on the second arm, will result in the wedge-shaped piece 16 being pointed toward the palm when the staple remover is used. Conversely, a reversal of these two grips between the two arms (or a reversal of the wedge-shaped piece 16 and the plate 20) will result in the wedge-shaped piece being pointed toward the fingers when this device is used. Either configuration is contemplated by this disclosure and its associated claims.

For a smaller staple remover wherein one arm is held against the thumb and the other arm is held against the index and middle fingers, wherein the thumb and said two fingers are pressed together to use the remover, the gripping means 12 and complementary gripping means 13 may comprise a pair of wings such as are commonly included on many commercially-available staple removers, as illustrated in FIGS. 10 and 11. However, the replacement of wings with finger and palm grips, or the use of any other grip configuration designed to facilitate comfortable use, is fully contemplated by this disclosure and its associated claims, and this disclosure and its associated claims are in no way limited to the specific gripping configurations illustrated herein.

Figure 12:
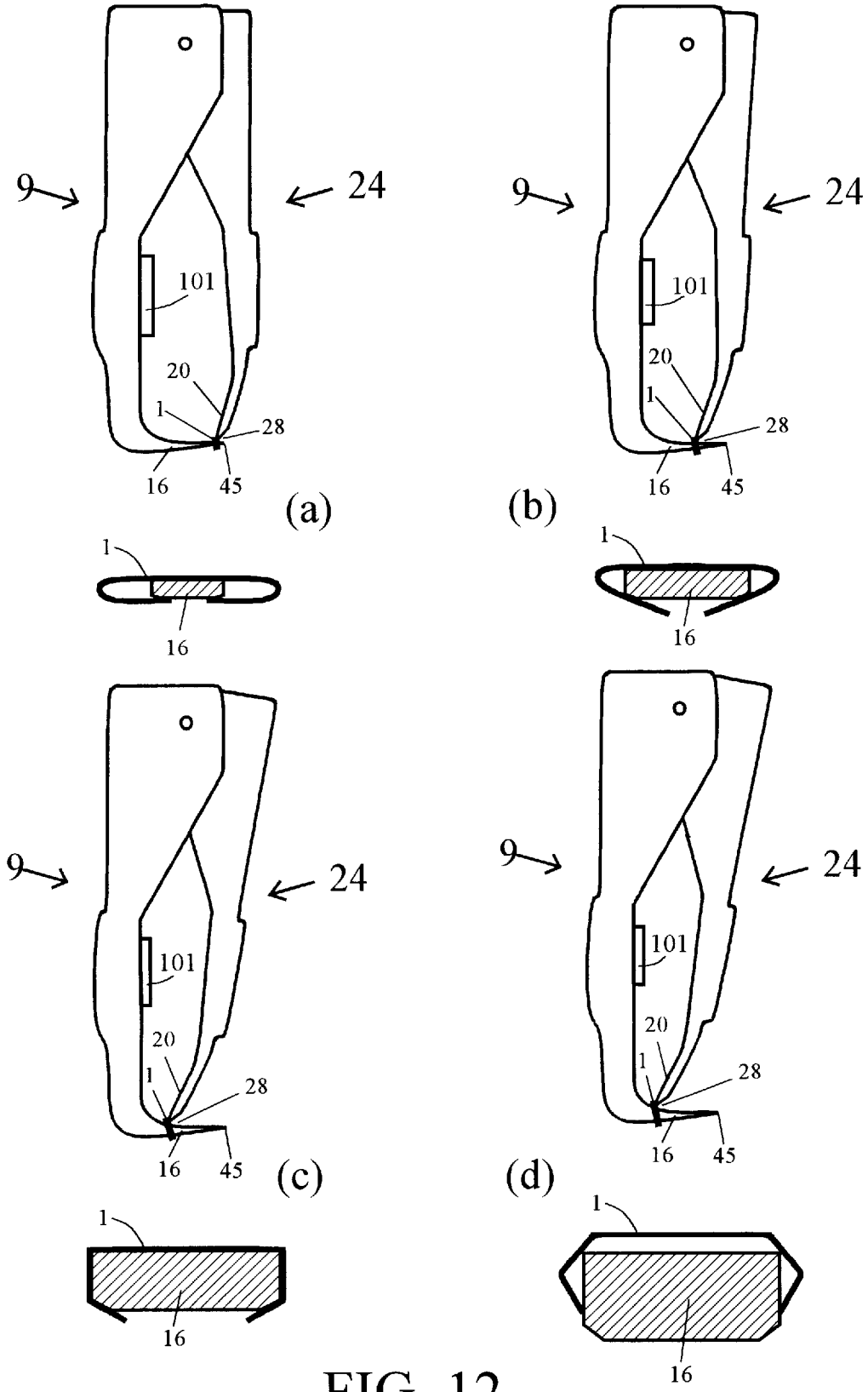
FIG. 12 illustrates the process by which all of the embodiments of the invention remove a staple.

FIG. 12 illustrates the process through which a staple 1 is removed by pressing the arms 9 and 24 together with the staple in appropriate placement relative thereto. Although the fourth preferred embodiment of FIGS. 10 and 11 is used for this illustration, it is understood that this manner of removing the staple 1 applies to all other illustrated embodiments, as well as obvious variations to these embodiments.

Recall that the arc of the wedge-shaped piece 16 has a radius centered about the pivot point at which the two arms are attached so as to maintain a substantially constant distance 28 as these arms are pressed together, and that this distance 28 is smaller than the gauge thickness of the staple 1. FIG. 12 depicts, starting from the upper left and moving to the lower right, how the plate presses against the staple 1 without lifting it, so as to secure the staple while the wedge-shaped piece 16 is moved under the staple 1. Beneath each of the four main drawings comprising FIG. 12 is a cross-sectional view (shaded with diagonal lines) of the wedge-shaped piece 16 as it moves between the staple legs and the region of the staple connecting the two legs. As the arms are pressed further together, moving from upper left to lower right in FIG. 12, the gradual widening and thickening of the wedge-shaped piece first pushed the staple legs down, and then spreads them apart, while the thickening of the wedge-shaped piece 16 also provides lift without the user having to pull or lift at all on the staple. The only action provided by the user, is the pressing together of the arms 9 and 24. As can be seen, the plate 28 is used to hold the staple in place so that the wedge-shaped piece 16 can be slid under the staple and used to remove it, but the plate is not at all used for any lifting of the staple. The maintenance of a substantially constant distance 28 less than the staple gauge width, between the wedge-shaped piece 16 and the plate 28, ensures that the plate will properly secure the staple throughout removal. This provides a much cleaner removal than the prior art, in which two opposing pieces are typically both used to lift the staple.

It is interesting to observe that the staple removing device and method disclosed thus far utilizes movement of a first arm 9 past a second arm 24, said second arm further comprising a plate 21 that may be at an angle 98 substantially perpendicular to a tangent to the arc through which the first arm 9 rotates toward the second arm 24, and that this is essentially also the configuration for a standard stapling device. (As noted above, there are of course a range of permissible variations for the angle 98, so long as the plate ends up holding the staple 1 in place for removal by the blade 16, rather than lifting the staple.) In simpler language, the embodiments disclosed above, for example, that of FIG. 1, appear very much like a stapler aside from the addition of the blade 16, and so one may wish to consider whether the staple remover disclosed above can be combined with a regular staple inserter (commonly referred to as a stapler).

Figure 13:
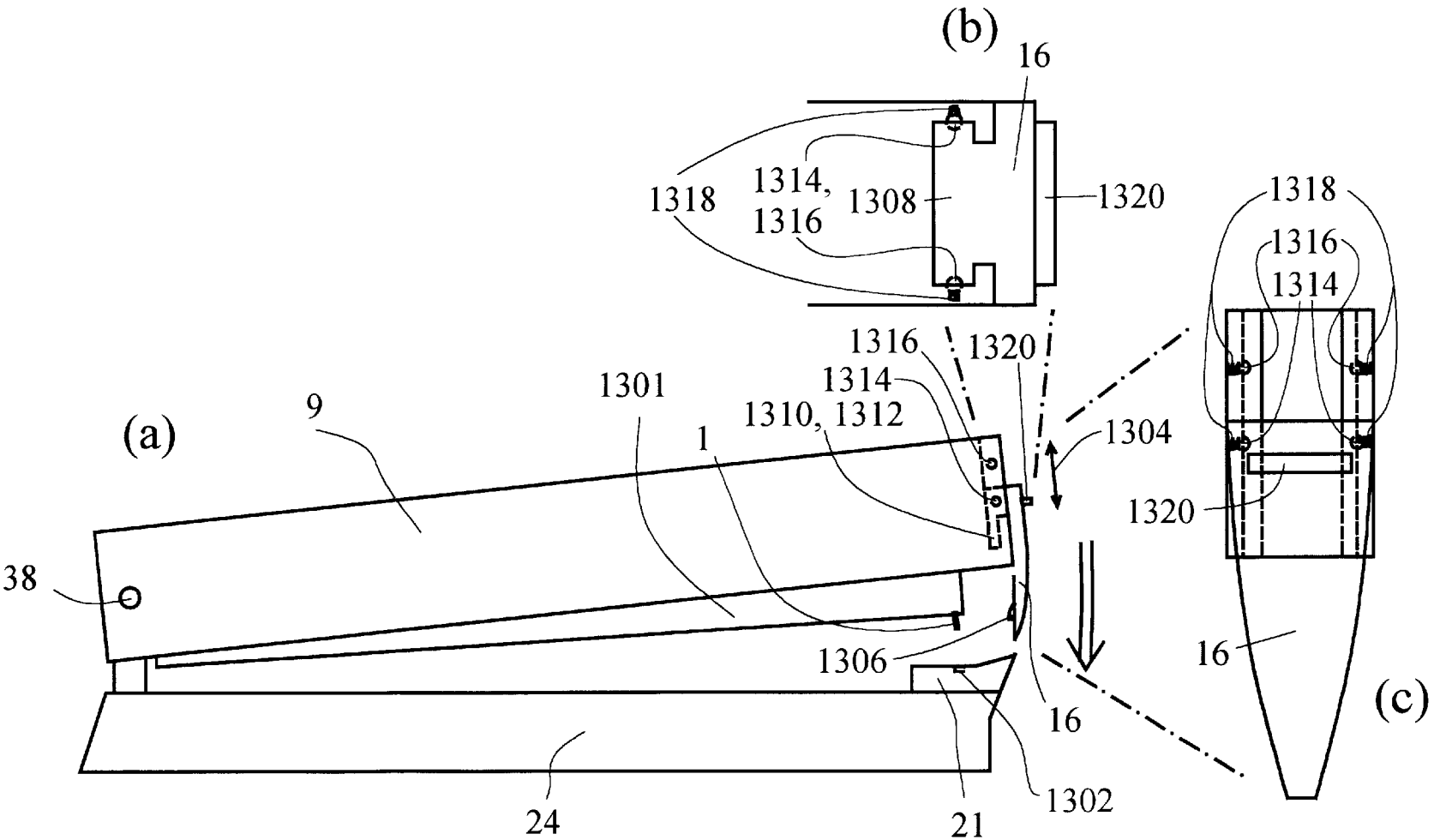
FIG. 13 illustrates a side view of the preferred embodiment of a combination stapler and staple remove wherein the staple remover invention as disclosed in FIGS. 1 through 12 is incorporated into a stapler, and further illustrates enlarged top and right-side views of the pertinent sections of this device.
Figure 14:
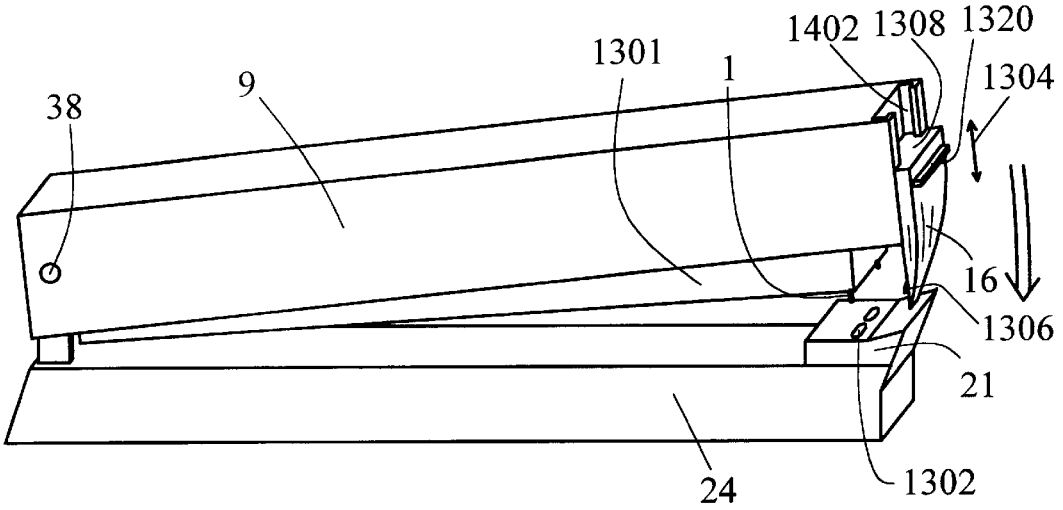
FIG. 14 is a perspective view of the device of FIG. 13, wherein the blade is moved into a staple removing position.
Figure 15:
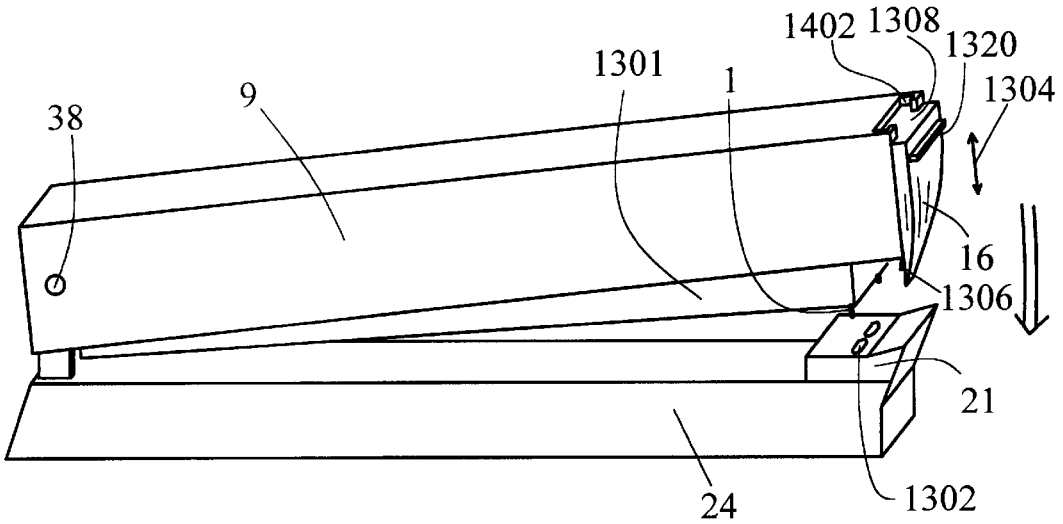
FIG. 15 is a perspective view of the device of FIG. 13, wherein the blade is moved into a stapling position.
Figure 16:
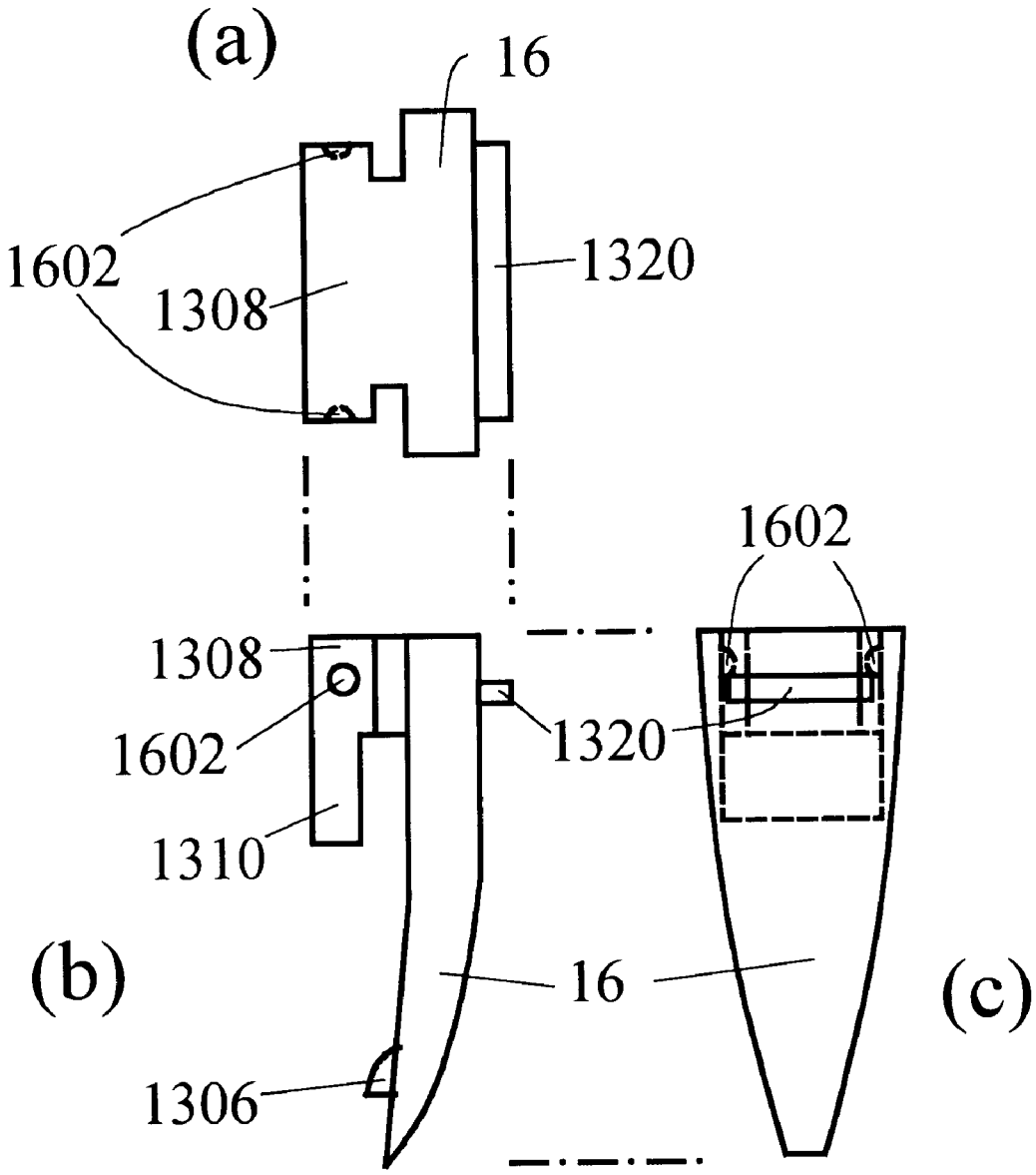
FIG. 16 illustrates three views of the blade used in the device of FIGS. 13, 14 and 15.

In fact, the above referenced features of the staple remover (particularly the movement of the blade 16 past the plate 21 about a common pivot point 38) lend themselves ideally to such a combination of staple insertion and staple removal. FIG. 13 illustrates a side view of a preferred embodiment of such a combination wherein the staple remover as disclosed in FIGS. 1 through 12 is incorporated into a stapler, and further illustrates enlarged top and right-side views of the pertinent sections of this device. FIGS. 14 and 15 illustrates a perspective views of this same device, as used for staple removal, and staple insertion, respectively.

Indeed, the device shown in FIG. 13 has the first arm 9, second arm 24, plate 21 residing on the second arm 24, and blade 16, wherein the blade 16 pivots with respect to the plate 21 about pivot point 38, just as disclosed in FIGS. 1 through 12 above. (As depicted here, the blade is at a fifteen degree angle relative to a line tangent to the arc of rotation about pivot point 38 in the region where the blade 16 moves past the plate 21. Again, a range of angles are acceptable for this, as discussed earlier.) However, these components are now all configured into a stapler with staple well 1301 partially enveloped by the lower portion of first arm 9 in the conventional manner, such that a staple 1 is ejected from the staple well 1301 in the conventional manner when the first arm 9 and the well 1301 are pressed downward about pivot point 38 toward the second arm 24, and such that said staple is bent into proper shape by the conventional staple bending indentations 1302 in the plate 21. (See FIG. 14 for a better, perspective view of these indentations 1302.) Note that the indentations 1302 as depicted force the legs of staple 1 together, but it is understood that this invention can readily be adapted to provide an optional set of indentations forcing the legs apart (not expressly shown), as is also common in the art.

Absent more, however, a difficulty with this configuration is that the blade 16 will move past the plate 21 for removal purposes at the same time that the first arm 9 and staple well 1301 are pressed together with arm 24 and a staple 1 is ejected for stapling purposes. Thus, if one's desire is to insert a staple into some papers or materials, the blade 16 will simultaneously cut into the papers or materials as the arms 9 and 24 are pressed together, which is of course undesirable. Conversely, if one's desire is to remove a staple, the action of removal, if the arms 9 and 24 are pressed too close together, will also act to eject an unwanted staple 1 from the well 1301. Thus, some further refinements are needed for both the staple insertion and staple removing functions to coexist simultaneously within the configuration of FIG. 13.

To resolve this dilemma, the blade 16 in the preferred embodiment of FIG. 13 is configured to be movable into either a staple insertion or a staple removal position. In FIGS. 13 and 14, the blade is positioned in its staple removal position; in particular, is slidably moved to a position downward along the directional arrow 1304. In FIG. 15, the blade is positioned in its staple insertion position; in particular, is slidably moved to a position upward along the directional arrow 1304.

When the blade 16 is in the staple removal position of FIG. 14, a blade stop 1306 prevents the blade 16 from moving past the plate 21 beyond the position at which the blade stop 1306 comes into contact with the plate 21. This allows the blade 16 to be moved past the plate far enough for a staple to be effectively removed as disclosed in connection with FIGS. 1 through 12, but prevents the arms 9 and 24 from being moved together so closely that a staple 1 is ejected from the well 1301. This resolves part of the above-referenced dilemma.

When the blade 16 is in the staple insertion position of FIG. 15, it is raised far enough upward along arrow 1304 so that it does not interfere with stapling, i.e., so that it does not protrude downward far enough so as to cut through the papers or materials while a staple is being inserted. This resolves the other part of the above-referenced dilemma. The blade stop 1306 in this position may also come to rest against the lower portion of first arm 9, thereby preventing the blade from being entirely removed, so that it cannot then be separated from the rest of the device and potentially become lost.

Referring to FIGS. 13 through 16, the above-referenced ability of the blade 16 to be moved into either a staple removal or a staple insertion position is achieved in the preferred embodiment as follows: The blade itself slides upward and downward in a channel 1402 expressly designed for that purpose. The channel is essentially a female member that is shaped to accommodate and mate with a male channel adapter 1308 integral with the blade, see FIG. 16. By virtue of the complementary channel configuration of 1308 and 1402, the blade is firmly secured in the correct position, and is prevented from wiggling in any direction other than the desired direction. A supplementary male channel adapter 1310 also enters a female supplementary channel 1312 (see FIGS. 13 and 16), which further secures the blade correctly when it is positioned for staple removal as in FIG. 14.

Further, in the preferred embodiment, to lock the blade 16 into either its lowered (removal) or its raised (insertion) position, a lower ball bearing pair 1314 and an upper ball bearing pair 1316, with appropriate spring tension 1318 on the ball bearings, act as male members complementing female ball bearing receptacles 1602 cut directly into the sides of the male channel adapter 1308. Thus, when the blade 16 is in its lower position, the lower ball bearing pair 1314 engages the ball bearing receptacles 1602. When the blade 16 is in its upper position, the upper ball bearing pair 1316 engages the ball bearing receptacles 1602. In either case, appropriate spring tension 1318 on the ball bearings secures the blade 16 properly in place.

Finally, a blade movement grip 1320 such as the protrusion depicted in FIGS. 13 through 16 is provided, which the user presses either upward or downward upon along the directional is arrow 1304, in order to facilitate: disengagement of the blade 16 from whichever ball bearing pair is presently locking it in place; sliding of the blade 16 to its alternate position; and engagement of the blade with the other ball bearing pair.

To summarize therefor, when the device herein is to be used for staple insertion, the user moves the blade 16 to its upper position along 1304 by pressing upward on the blade movement grip 1320 until the blade is secured by the upper ball bearing pair 1316 in the position of FIG. 15. In this position, the blade does not protrude down far enough to cut through the paper, material, etc. being stapled, and so the device is used effectively as an ordinary stapler. Alternatively, when the device herein is to be used for staple removing, the user moves the blade 16 to its lower position along 1304 by pressing downward on the blade movement grip 1320 until the blade is secured by the lower ball bearing pair 1314 in the position of FIG. 16. In this position, the blade stop 1306 will enable the blade 16 to move past the plate 21 only far enough for the staple to be removed, but will not allow the blade to move past the plate 21 so far that a staple 1 is ejected from the staple well 1301 by virtue of the arms 9 and 24 being pressed too closely together.

While FIGS. 13 through 16 depict a preferred embodiment for implementing a combined staple inserter and staple remover, there are many variations which are possible that will be obvious to someone of ordinary skill. For example, while the blade 16 in this embodiment is moved by sliding, it is possible to move (or remove) it in other ways. For example, it can be attached to the stapler upper arm in the position of FIG. 14 by, e.g., an appropriately situated nut and bolt pair when the device is to be used for staple removal, and can be removed entirely when the device is to be used as a staple inserter. Appropriate grooving and/or channeling can be used to ensure proper blade positioning and absence of undesired blade movement. A blade storage receptacle can be hollowed out or otherwise introduced into any desired region of the device for storing and securing the blade when it is not being used for staple removal, to avoid the blade becoming lost. Used of magnets in this connection is also feasible. Further, while a particular channel and ball bearing arrangement is illustrated in FIGS. 13 through 16, someone of ordinary skill can readily conceive many other similar configurations for securing the blade in its proper position when it is used for staple removal, and for moving (e.g., sliding, removing) the blade into an alternative position or location when it is not being so-used. All of the many alternative variations that would be obvious to someone of ordinary skill in the means used to secure the blade in position and allow appropriate movement of the blade between staple insertion and staple removal configurations are understood to be encompassed by this disclosure and its associated claims. Known methods used, e.g., for switch blades (wherein a blade pops up and locks into place by a spring action and is similarly retracted), are among the many options available for the fundamental purpose of moving the blade into position for use, or retracting the blade when it is not in use.

Figure 17:
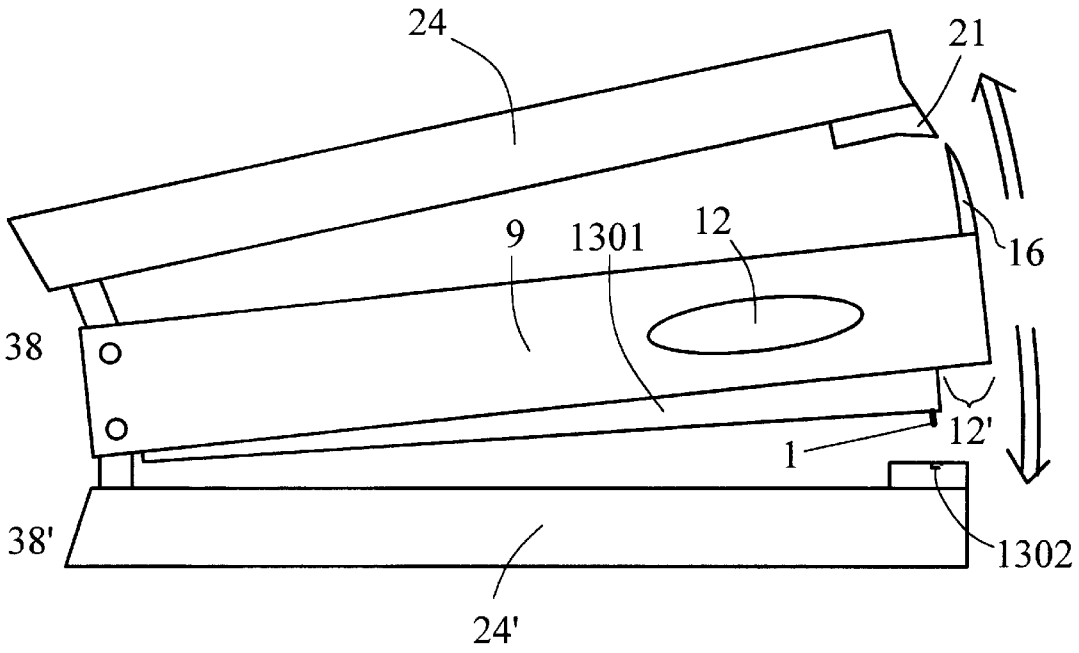
FIG. 17 illustrates a side view of a second preferred embodiment of a combination stapler and staple remover.

FIG. 17 illustrates a side view of a second preferred embodiment of a combination stapler and staple remover. In this variation, the combined stapler and staple remover has a total of three distinct arms. First arm 9 with blade 16 pivots about pivot point 38 past the plate 21 of second arm 24, as has been the case throughout. However, in this situation, the first arm 9, sits between the second arm 24 and a third arm 24'. The third arm comprises the staple bending indentations 1302 and the first arm houses the staple well 1301, ejecting staples 1. The blade 16 points toward the second arm 24, and the staple well points toward the third arm, as shown.

In this embodiment, the process of inserting a staple involves pressing the first arm 9 toward the third arm 24', until they are pressed closely enough so that a staple 1 is ejected and pressed against the bending indentations 1302, in the conventional manner (lower, downward-pointing double arrow). The process of removing a staple involves pressing the first arm 9 toward the second arm 24 and thereby moving the blade 16 past the plate 21 in the manner disclosed and described previously (upper, upward-pointing double arrow).

To prevent the user of this embodiment from pressing the first 9 and second 24 arms together (removal) when the object is to insert a staple 1, and to alternatively prevent said user from pressing the first 9 and third 24' arms together (thereby ejecting a staple 1) when the object is to remove a staple, gripping means 12, as earlier described above, are provided. While FIG. 17 is a side view, these grips 12 (e.g. wings) extend outward from the two sides of the first arm 9, and enable the user to grip the first arm 9 in conjunction with either the second arm 24 (for removal) or the third arm 24' (for insertion), but not both. Alternatively, if the region designated 12' between the end of the staple well 9 and the end of the first arm 12 is made sufficiently long, then the device can be gripped in the region 12' when the first arm 9 is being pressed together with the second arm 24 without a staple being ejected (since there will be no pressure on the staple well 1301), while the first arm 9 can be pressed on its top surface in the region designated 1702 down toward third arm 24' when a staple is being inserted. It should also be noted that in this embodiment, there is no harm in simply pressing the second arm 24 down into contact with the first arm 9, and then further pressing both of these arms down until the first arm 9 and the well 1301 contact the third arm 24' so as to eject a staple, since the remover in this embodiment does not at all interfere with the stapler. Of course, the above is illustrative only, and many obvious variations will occur to someone of ordinary skill which are contemplated by this disclosure and its associated claims.

Figure 18:
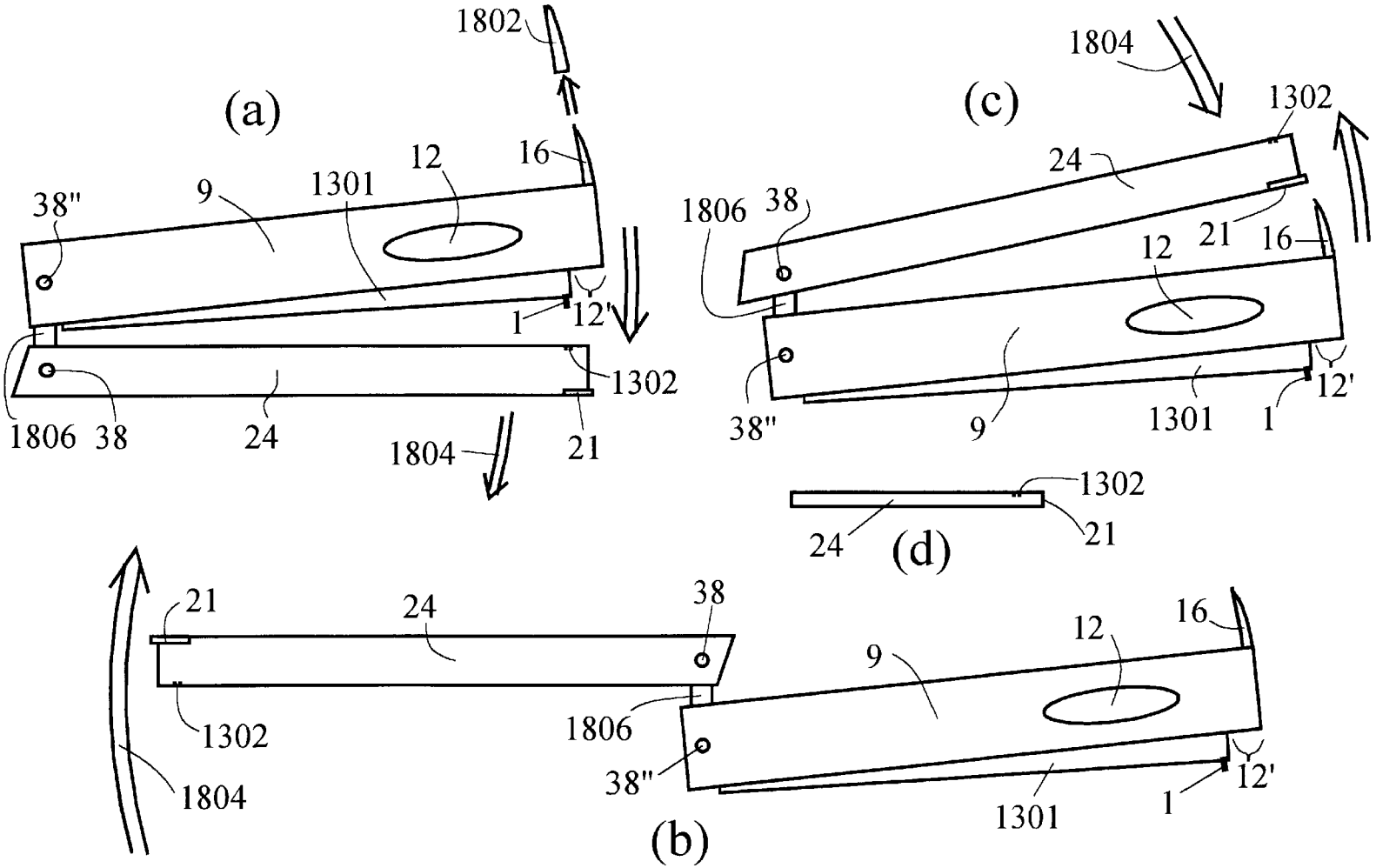
FIG. 18 illustrates a side view of a third preferred embodiment of a combination stapler and staple remover.

FIG. 18 illustrates a side view of a third preferred embodiment of a combination stapler and staple remover. This embodiment is based once again on a standard two arm stapler configuration, wherein the second arm 24 serves the role of both the second arm 24 and the third arm 24' from FIG. 17, by virtue of its ability to pivot through an angle of up to 360 degrees about the first arm 9.

In particular, drawing (a) of FIG. 18 depicts this embodiment configured as a standard stapler. First arm 9 and its well 1301 are pressed down against second arm 24 until a staple 1 is ejected and bent on bending indentations 1302. Note that 38" is the (second) pivot point about which the first arm pivots toward the second arm in order to insert a staple. Blade 16 is located on and affixed to the upper portion of first arm 9, and because it is exposed in this configuration, it is covered by a safety sheath 1802 which fits snugly over the blade and is fabricated from hard rubber, plastic, leather, or any other material suitable for sheathing a blade for reasons of safety. Plate 21 is now located on the lower surface of the lower arm 24, for reasons that will shortly become apparent.

In order to convert this device into the configuration required for staple removal, the sheath 1802 is of course removed to expose the blade. Additionally, the first arm 24 is rotated in the direction 1804 about the second pivot point 38" for approximately 180 degrees, until it reaches the configuration shown in drawing (b) of FIG. 18. This is in fact a standard stapler configuration, and is the configuration commonly used when a staple is to be inserted onto a flat surface such as a bulletin board, rather than through sheets or cloth. Thus, the second arm 24 is configured in a staple insertion position in either of FIGS. 18(*a*) or (*b*). Thereafter, however, the second arm continues to rotate for approximately another 180 degrees in the direction 1804 about pivot point 38, until it has pivoted reached the configuration shown in drawing (c) of FIG. 18. In essence, the two pivot points 38 and 38", in conjunction with connecting member 1806 connecting said pivot points, serve to create a double-jointed device wherein the second arm 24 is thereby capable of a 360 degree rotation about the first arm 9. Of course, the arms 9 and 24 will contain appropriate notches, spaces, or other clearance areas through which the connecting member 1806 may move in order to permit the necessary 360 degree rotation. And, of course, many methods will be obvious to those of ordinary skill for achieving this 360 degree pivot to facilitate this embodiment, all of which are contemplated within this scope of this disclosure and its associated claims.

Once the configuration of FIG. 18(*c*) is achieved, the plate 21 will have swung around such that it is in the necessary proximity to the blade 16 to permit staple removal, as has been described before. (In this embodiment, the plate is illustrated at ninety degrees with respect to the blade tangent.) At this point, the second arm has been moved into its staple removal position. By then moving the first arm 9 toward the second arm 24 through the final remaining distance (upward-pointing double arrow in (c)), the device is used as described to remove staples. Grip 12 again permits these arms to be moved together without pressure being applied to staple well 1301 (thus avoiding unwanted staple ejection), and again, if area 12' is of sufficient length, the device can alternatively be gripped in that region to facilitate removal.

Further, if the lower arm 24 is sufficiently thin (as is often the case for the lower arm of "miniature" staplers), then the lower arm may be readily fabricated so that the plate 21 is nothing more than the end of the surface containing the bending indentations 1302, as illustrated by a section of a thin lower arm 24 in drawing (d) of FIG. 18.

Figure 19:
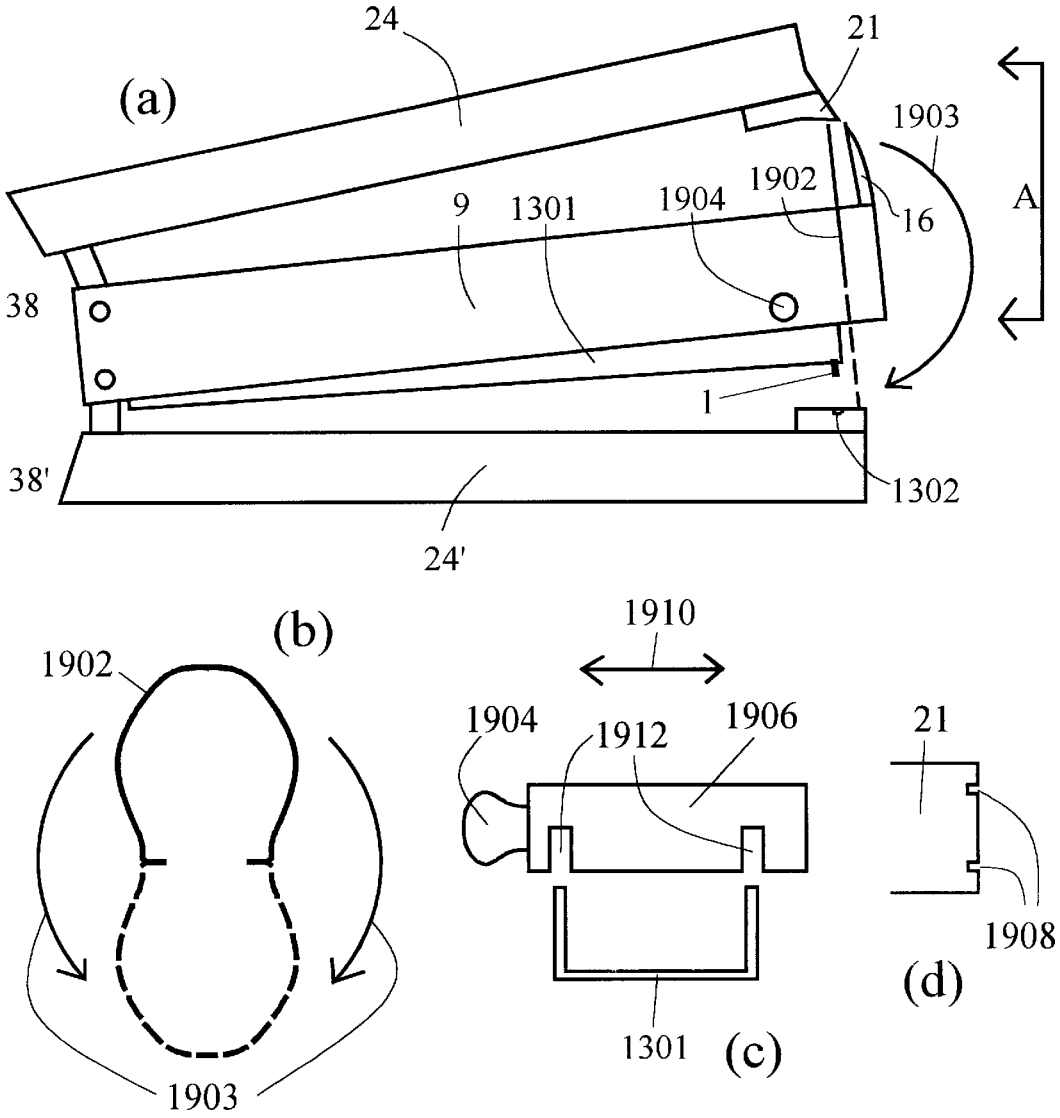
FIG. 19 illustrates some further enhancements to various preferred embodiments of the invention.

FIG. 19 discloses some further variations of the preferred embodiment of the invention. Recall that a blade stop 1306 was introduced in FIGS. 13 to 15 to prevent the blade 16 from moving past the plate 21 so far that a the first arm 9 and the second arm 24 would compress together and eject a staple 1 from the well 1301. In FIGS. 17 and 18, this problem was averted by the grips 12 or 12'. In all of these situations, the key objective is to prevent the well 1301 and the first arm 9 from compressing together to the point where an unwanted staple is ejected. The above are some examples of what shall more generally be referred to as a staple ejection prevention device. Several non-limiting alternatives for suitable ejection prevention devices are disclosed in FIG. 19.

For example, a rotatable ring 1902 may be introduced into the first arm 9 as shown attached to the stapler in the upper part of FIG. 19, and as shown in the lower left of FIG. 19 from the view labelled A. (The stapler used in this illustration is borrowed from FIG. 17, but the discussion to follow applies to the other related embodiments as well.) When this rotatable ring 1902 is in its staple insertion position (indicated by the unbroken line), the first arm 9 is free to descend all the way down toward arm 24' to the point that a staple 1 is ejected from the well 1301. But when it is rotated to its staple removal position along 1903, it will press against the arm 24 (or the plate containing the indentations 1302) and prevent the well 1301 and the first arm 9 from ever compressing together far enough to eject a staple. This ring can also be appropriately positioned on the arm 24' (or 24) toward the same effect, and it is helpful to provide catches or similar mechanisms to stabilize the ring in either of its two positions shown, i.e., to prevent totally free rotation along 1903 by the ring and ensure that some amount of pressure must be provided in order to nudge the ring out of one of its two stable positions.

Another alternative ejection prevention device is a staple well lock 1906 with well lock knob 1904. This well lock 1906, when used as a component of the stapler, slides back and forth along the direction 1910, which means that it slides in and out of the page insofar as the upper illustration in FIG. 19 is concerned. It runs through and makes contact with the first arm 24. The well lock also has a pair of staple well clearance notches 1912, which are separated from one another by the width of the staple well. Thus, when the well lock 1906 is slid to a staple insertion position wherein the notches 1912 are aligned directly above the vertical edges of the staple well 1301 (shown in cross-sectional view in the lower middle illustration), the first arm and the well can be compressed sufficiently so that a staple is ejected. However, when the well lock 1906 is slid to a staple removal position wherein the notches 1912 are not so aligned above the vertical edges of the staple well 1301, then the vertical edges of the well 1301 cannot compress into the first arm 9, and so a staple cannot be ejected. Again, these are only illustrations, and many variations and substitutions for the above will be obvious to someone of ordinary skill.

Finally, it is desirable that the staple remover disclosed throughout can be used with varying sizes of staple. This is achieved, without any changes to the wedge-shaped piece 16, by placing appropriate plate notches 1908 in the plate 21 as shown in the lower right illustration of FIG. 19. Thus, for example, if the notches 1908 are separated by 9 millimeters, the removal device employing that plate can be used to remove both standard width (12 millimeter) and miniature (9 millimeter) staples. The same applies to any other widths that may be available or may become available in the future.

While only certain preferred features of the invention have been illustrated and described, many modifications and changes will occur to those skilled in the art. It is, therefore, to be understood that the appended claims are intended to cover all such modifications and changes as fall within the true spirit of the invention.

I claim:

1. A device for removing staples of given width and leg length, comprising a wedge-shaped piece, a plate, and a first arm, pivotally attached to a second arm at said pivot point;

said first arm comprising said wedge-shaped piece and a staple well; and said second arm comprising said plate and at least one staple bending indentation, wherein:

said wedge-shaped piece and said plate pivot with respect to one another about a common pivot point; wherein a front surface of said wedge-shaped piece is curved in an arc with a radius of curvature determined such that the origin of the arc coincides substantially with the position of said pivot point; and wherein at a point of closest proximity between said wedge-shaped piece and a flat edge of said plate when said wedge-shaped piece and said plate are pivoted together, said plate is aligned at an angle wherein said plate holds a staple in place for removal by said wedge-shaped piece without said plate lifting said staple.

2. The device of claim 1, said wedge-shaped piece having a tip at one end, a second end, and a removal region between said one end and said second end; wherein said wedge-shaped piece varies in width such that it is narrowest at its tip and becomes gradually wider toward its removal region; and wherein said wedge-shaped piece varies in thickness such that it is narrowest at its tip and becomes gradually thicker toward its removal region.

3. The device of claim 2, wherein at said removal region, the sum of said width plus twice said thickness of said wedge-shaped piece exceeds substantially four millimeters less than the total sum of the width plus twice the leg length of said staples which said device is to be used to remove.

4. The device of claim 3, wherein at said removal region of said wedge-shaped piece, the sum of said width of said wedge-shaped piece plus twice the thickness of said wedge-shaped piece exceeds 18 millimeters.

5. The device of claim 1, wherein at said point of closest proximity, said plate is aligned along a first plane differing by an angle substantially between sixty and one hundred twenty degrees with respect to a second plane tangent to said front surface of said wedge-shaped piece.

6. The device of claim 1, wherein at said point of closest proximity, said plate is aligned along a first plane differing by an angle from among the group of angles consisting of substantially seventy five degrees, substantially ninety degrees, and substantially one hundred five degrees with respect to a second plane tangent to said front surface of said wedge-shaped piece.

7. The device of claim 1, said first arm further comprising gripping means.

8. The device of claim 1, said second arm further comprising complementary gripping means.

9. The device of claim 1, further comprising a spring biasing said first and second arms.

10. The device of claim 9, wherein said spring is positioned inside said first arm.

11. The device of claim 9, wherein said spring is positioned inside said second arm.

12. The device of claim 1, including a means for shielding the user's fingers.

13. The device of claim 1, wherein said plate is metallic.

14. The device of claim 1, wherein said plate is composed of hard material.

15. The device of claim 1, wherein said wedge-shaped piece is a solid, wedge-shaped blade.

16. The device of claim 1, wherein:

said first arm further comprises a first end and a second end, and a female slot proximate to said first end; wherein said second arm further comprises a first end and a second end, said second arm being pivotally attached to said first arm at said pivot point, inside said female slot; and wherein said wedge-shaped piece is proximate to said second end of said first arm and said plate is proximate to said second end of said second arm.

17. The device of claim 1, further comprising a magnet to attract a staple once said staple is removed.

18. The device of claim 1, wherein said plate further comprises at least one plate notch.

19. The device of claim 1, wherein said wedge-shaped piece and said plate are integrated into a staple insertion device.

20. The device of claim 1, wherein:

staples residing in said staple well are ejected for insertion by moving said wedge-shaped piece into a staple insertion position and then pressing said first arm and said staple well together; and wherein a staple is removed by moving said wedge-shaped piece into a staple removing position and then so-pivoting said wedge-shaped piece and said plate with respect to one another about said common pivot point.

21. The device of claim 1, further comprising a staple ejection prevention device.

* * * * *